United States Patent [19]

Gebert

[11] Patent Number: 4,934,521

[45] Date of Patent: Jun. 19, 1990

[54] KEY CASE

[75] Inventor: Paul Gebert, Cartersville, Ga.

[73] Assignee: Key Keepr, Inc., Cartersville, Ga.

[21] Appl. No.: 397,657

[22] Filed: Aug. 23, 1989

[51] Int. Cl.[5] ..... A45C 11/00

[52] U.S. Cl. ..... 206/37.1; 206/37.2

[58] Field of Search ..... 206/37.1, 37.2–37.8

[56] References Cited

U.S. PATENT DOCUMENTS

| | | | |
|---|---|---|---|
| 804,545 | 11/1905 | Paine | 206/37.1 |
| 1,139,370 | 5/1915 | Putnam | 206/37.1 |
| 1,414,798 | 5/1922 | Welcker | 206/37.1 |
| 2,130,469 | 9/1938 | Nasser | 206/37.1 |
| 2,912,030 | 11/1959 | Stiller | 206/37.1 X |
| 3,007,568 | 11/1961 | Kurland | 206/37.1 X |

FOREIGN PATENT DOCUMENTS

| | | | |
|---|---|---|---|
| 1632554 | 9/1969 | Fed. Rep. of Germany | 206/37.1 |
| 668161 | 7/1929 | France | 206/37.1 |
| 719821 | 2/1932 | France | 206/37.1 |
| 266740 | 8/1929 | Italy | 206/37.1 |
| 286785 | 3/1928 | United Kingdom | 206/37.1 |
| 419005 | 11/1934 | United Kingdom | 206/37.1 |

*Primary Examiner*—William Price

*Attorney, Agent, or Firm*—John L. James

[57] ABSTRACT

A key case is provided which contains an upper end portion with an opening, a lower end portion with an opening, and a sidewall extending between the upper and lower end portions and defining a cavity that is accessible through the opening of the upper end portion and through the opening of the lower end portion. The key case includes a key ring and apparatus, connected to the key ring, for raising the key ring into the cavity adjacent the upper end portion and lowering the key ring from the cavity through the opening of the lower end portion. The key case holds a plurality of keys in a neat, compact package that shields the keys from contact with a pocket or purse and minimizes jingling. Keys are easily added or removed from the key case and the key case is simple to operate.

7 Claims, 3 Drawing Sheets

10
12
14
16
18
20
22
24
26
28
30
10'
12'
14'
16'
18'
20'
22'
24'
26'
28'
10''
14''
24''
26''

44

32
34
46
48
44
54
42
40
38
50
52
36

44
42
48
42
40
54
46

44
42
42
40
54
48
46

36
52
52

44
42
42
40
54
48
46

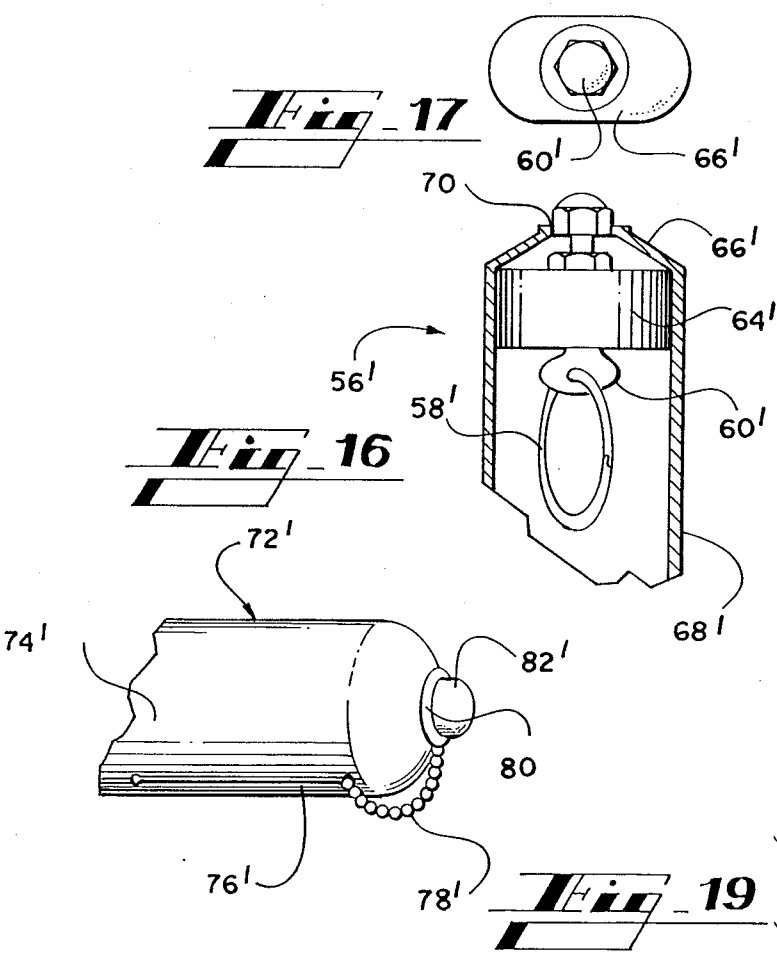
Fig. 17
Fig. 16
Fig. 19
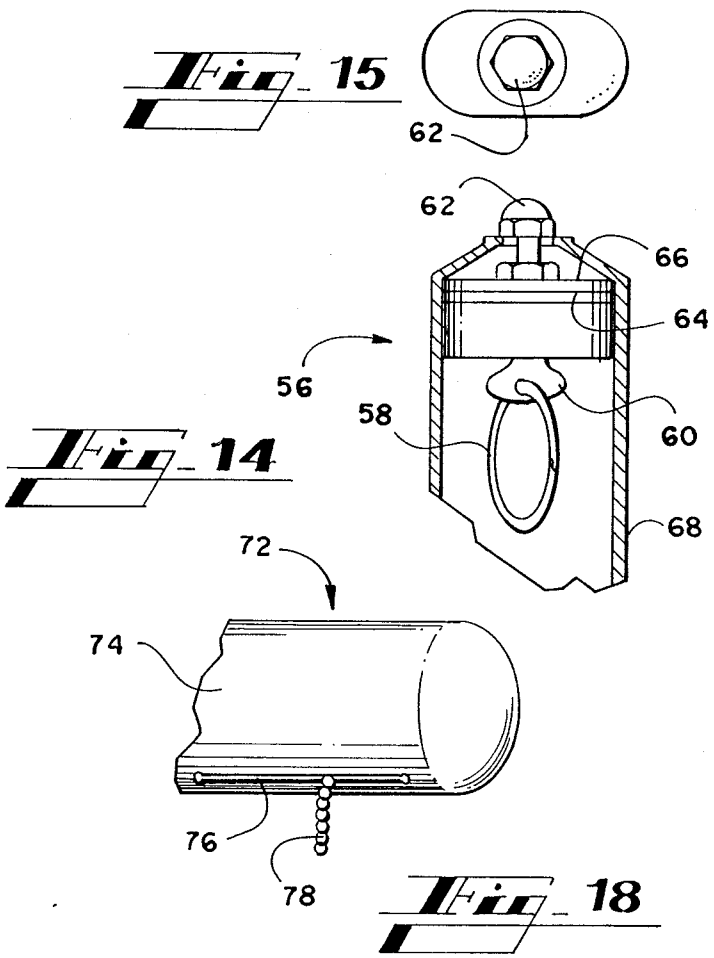
Fig. 15
Fig. 14
Fig. 18

KEY CASE

TECHNICAL FIELD

This invention relates generally to keys, and more particularly relates to a key case for holding a plurality of keys.

BACKGROUND OF THE INVENTION

Keys are a necessary item in modern society. A typical person has a variety of keys to gain access to his home, automobile and place of employment. Many people will have two keys for each automobile, and a key for each door of their home or apartment. In addition, in the home, a person may have keys to fit safes, medicine cabinets, freezers, desks and other items. In the office, a person may also have several keys. It is apparent that a person has a need for a plurality of keys.

A person typically keeps a plurality of keys on a key ring or in a key case for convenience. Unfortunately, carrying keys in a trouser pocket on a key ring exposes the trouser pocket to damage from the keys which may rub or poke holes in the pocket. Keys can also damage a jacket or other garment if carried in a pocket. Keys on a key ring can similarly damage a purse. Also, keys carried on a key ring have a tendency to jingle making an annoying noise.

Keys kept in a key case do not make as much annoying noise as keys kept on a key ring, but key cases tend to be bulky items. In a key case, the keys are arranged on a bar in a linear fashion with the bar dictating the size of the key case. A key case to hold several keys usually has a long bar and can be quite bulky and therefore undesirable. A bulky key case also damages pockets and can distort the lining of a jacket if kept in the jacket pocket. It will be appreciated that it would be highly desirable to have a key case for carrying a plurality of keys that is not bulky and keeps the keys from making annoying noises when carried in a pocket or purse.

SUMMARY OF THE INVENTION

The present invention is directed to overcoming one or more of the problems set forth above. Briefly summarized, according to one aspect of the invention, a key case contains an upper end portion with an opening, a lower end portion with an opening, and a sidewall extending between the upper and lower end portions and defining a cavity that is accessible through the opening of the upper end portion and through the opening of the lower end portion. The key case includes a key holding device and apparatus, connected to the key holding device, for raising the key holding device into the cavity adjacent the upper end portion and lowering the key holding device from the cavity through the opening of the lower end portion.

It is an object of the present invention to provide a key case for housing a plurality of keys. The key case accommodates a number of keys depending on the size of the key ring used.

Another object of the present invention is to provide a key case that prevents keys from poking or wearing holes in a pocket. The key case housing shields the purse or pocket from the keys and thereby prevents the keys from poking holes. The key case is compact to minimize wear. The keys lay almost flat on the key ring thereby minimizing bulging of the key case.

Another object of the invention is to provide a key case that is easy to use. The key case holds keys on a conventional key ring and the keys are easily removed or added.

These and other aspects, objects, features and advantages of the present invention will be more clearly understood and appreciated from a review of the following detailed description of the preferred embodiments and appended claims, and by reference to the accompanying drawings.

BRIEF DESCRIPTION OF THE DRAWINGS

FIG. 14 is a diagrammatic, longitudinal sectional view of a key case similar to FIGS. 11–13, but illustrating another embodiment.

FIG. 15 is a top view of the key case illustrated in FIG. 14.

FIG. 16 is a sectional view of a key case similar to FIG. 14, but illustrating another embodiment.

FIG. 17 is a top view of the key case illustrated in FIG. 16.

FIG. 18 is a diagrammatic perspective view of a key case similar to FIG. 4, but illustrating another embodiment.

FIG. 19 is a perspective view of a key case similar to FIG. 18, but illustrating another embodiment.

DETAILED DESCRIPTION OF THE PREFERRED EMBODIMENTS

Figures 1, 2, 3, 4, 5, 6, 7:
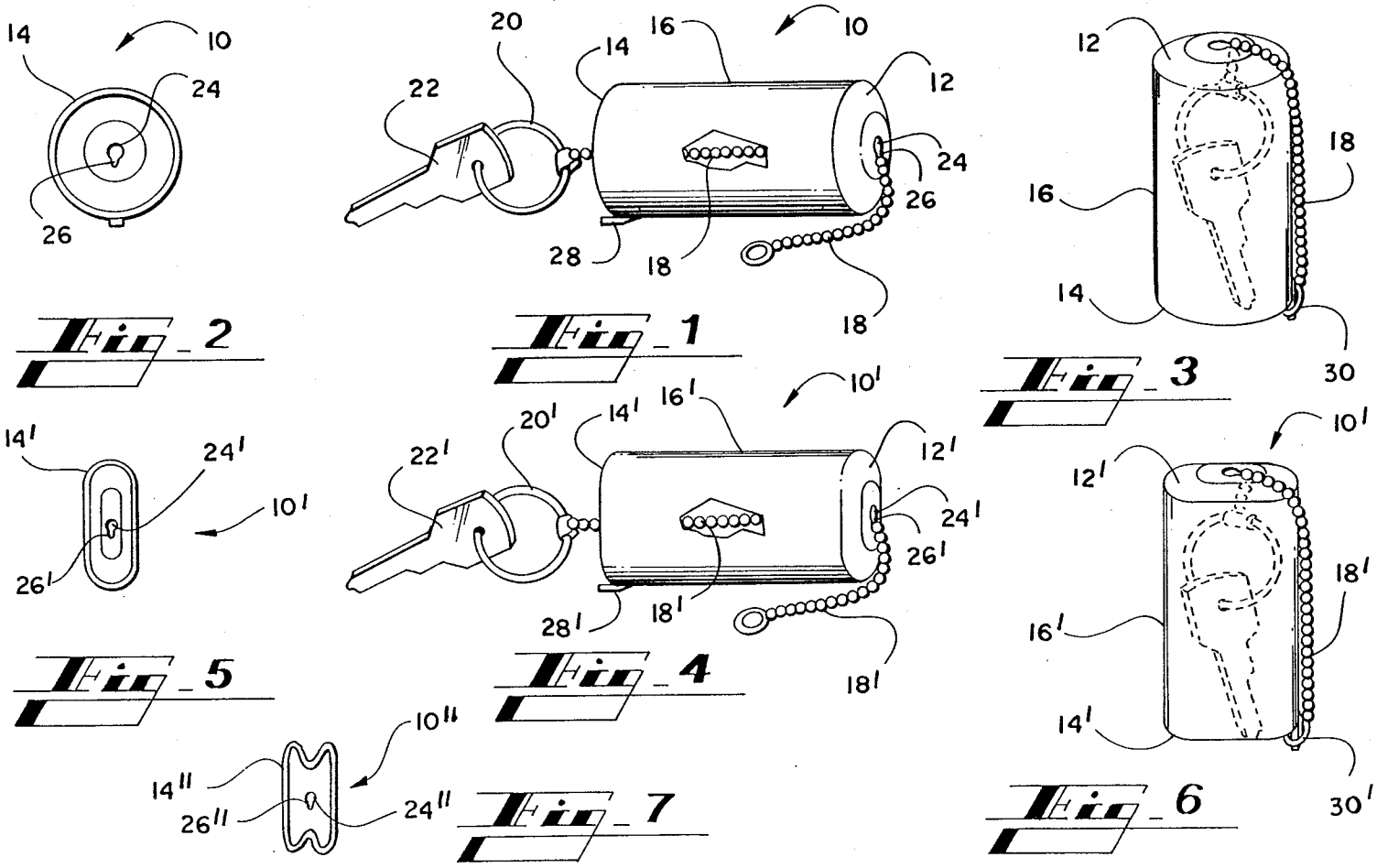
FIG. 1 is a diagrammatic perspective view of a preferred embodiment of a key case according to the present invention.
FIG. 2 is a left end view of the key case of FIG. 1.
FIG. 3 is a front view of the key case of FIG. 1 illustrating the key case in an upright position with keys stored inside.
FIG. 4 is a diagrammatic perspective view of a key case view similar to FIG. 1, but illustrating another embodiment.
FIG. 5 is a left end view of the key case of FIG. 4.
FIG. 6 is front view of the key case of FIG. 4 illustrating the key case in an upright position with keys stored inside.
FIG. 7 is a left end view of a key case similar to FIGS. 2 and 5, but illustrating another embodiment.

Referring now to the drawings, in which like numerals indicate like elements throughout the several figures, FIG. 1 illustrates a key case 10 that has an upper end portion 12, a lower end portion 14, and a sidewall 16 extending between the upper end portion 12 and the lower end portion 14. The key case 10 is equipped with a chain 18 and a key ring 20 attached to one end of the chain 18. One or more keys 22 are attached to the key ring 20. A section of the sidewall 16 is cut away revealing the chain 18 passing through the interior of the key case 10. The upper end portion 12 has an opening 24 through which the chain 18 passes. The opening 24 has a notch or groove 26 which entraps the chain 18 to keep the chain 18 from sliding through the opening 24 and also locking the chain 18 in position to suspend the key ring 20 and keys 22 at a desired position either protruding from the key case 10 or stored inside the key case 10.

Referring to FIGS. 2–3, the key case 10 is illustrated with a cylindrical configuration. The upper end portion 12 of the key case 10 is tapered to reduce the bulk of the key case 10 and to allow the key ring 20 to travel to the uppermost portion of the upper end portion 12 of the key case 10. The sidewall 16 of the key case 10 has a protrusion 28 that extends beyond the lower end portion 14 of the key case 10 for engaging a ring 30 that is on one end of the chain 18. When the ring 30 is engaged with the protrusion 28, the portion of the chain 18 extending from the key case 10 is held in position so that it does not jingle or flop around in an annoying manner and maintains the key ring 20 in position.

In operation, keys 22 are slipped onto the key ring 20 side by side and lay against one another in a compact bundle. Because the keys 22 lay on their sides, they form a flat bundle equal to the thickness of two or three keys, or so, depending on the sizes and shaped of the keys 22. The keys 22 are pulled into the key case 10 by pulling on the chain 18. The chain 18 is engaged with the slit 26 and locked in position to suspend the key ring 20 and keys 22 adjacent the upper end portion 12 of the key case 10. The loose end of the chain 18 is equipped with a ring 30 that may be hooked over the protrusion 28 to further keep the keys 22 suspended and to keep the chain 18 from jingling. The ring 30 may also be used to carry a particular key, such as a house key or automobile key. It is particularly helpful to attach an automobile key to the ring 30 so that the automobile key is always ready for immediate use without. This feature is helpful in high crime areas where it is desired to gain entry as quickly as possible without delays caused by fumbling for the right key.

The keys 22 are lowered by removing the ring 30 from the protrusion 28, disengaging the chain 18 from the slit 26, and lowering the chain 18 through the opening 24. When the keys 22 protrude from the lower end portion 14 of the key case 10, they are ready for use. The ring 30 has a size sufficient for preventing the chain 18 from falling through the opening 24.

Referring now to FIGS. 4–6, the key 10′ case has a compressed cylindrical configuration. The cross sectional configuration is more oval-shaped than the configuration in FIGS. 1–3 to accommodate a larger key ring 20′ and therefore more keys. The upper end portion 12′ is also rounded to allow the key ring 20′ to be pulled into the key case 10′ to the uppermost portion of the upper end portion 12′. The oval-shaped configuration is preferable over the cylindrical configuration where the key case 10 is to be carried in a pocket requiring a flat or thin case to avoid bulges in the pocket.

Referring to FIG. 7, the cross section of the lower end portion 14″ of the key case 10″ is flattened with folds or pleats in the sides. The pleats or folds permit the key case to be flattened when housing a small number of keys and expanded to accommodate a larger number of keys. This pleated configuration allows the key case 10″ to adopt the most compact configuration to house the keys.

Figures 8, 9, 10, 11, 12, 13:
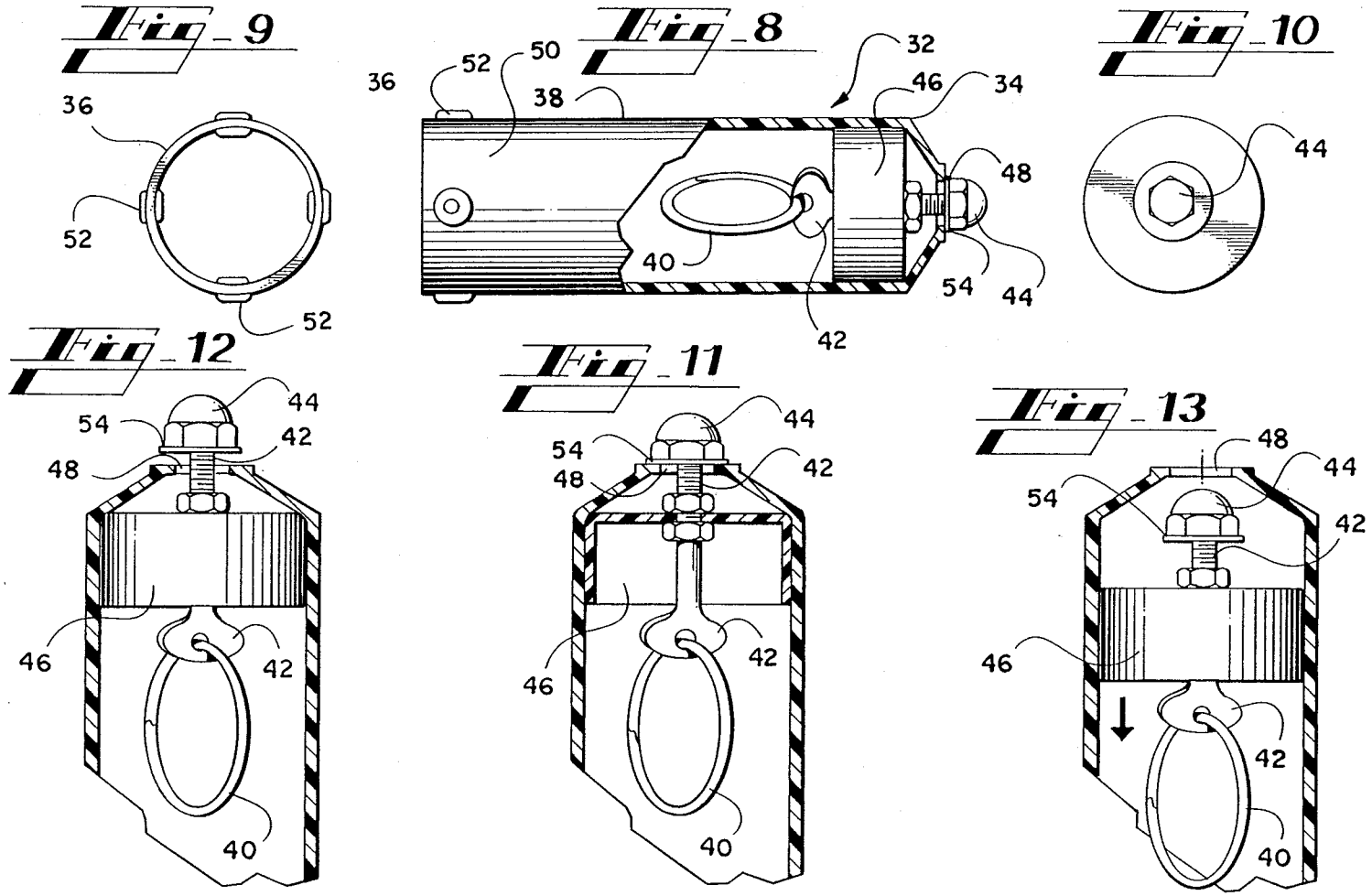
FIG. 8 is a side view of a key case similar to FIGS. 1 and 4, but illustrating another embodiment.
FIG. 9 is left end view of the key case illustrated in FIG. 8.
FIG. 10 is a right end view of the key case illustrated in FIG. 8.
FIG. 11 is a diagrammatic, longitudinal sectional view of the key case illustrated in FIG. 8 showing the key case in the normal position for carrying and storing keys.
FIG. 12 is a longitudinal sectional view similar to FIG. 11, but illustrating the key with the handle at its uppermost position.
FIG. 13 is a longitudinal sectional view similar to FIG. 11, but illustrating the handle in a lowered position for exposing the keys for use.

Referring to FIGS. 8–10, another embodiment of a key case is illustrated wherein the key case 32 has an upper end portion 34, a lower end portion 36, and a sidewall 38 extending between the upper end portion 34 and lower end portion 36. The key case 32 is illustrated with a cylindrical configuration although other cross sectional configurations may be used. Inside the sidewall 38 is a key ring 40 that is attached to one end of a shaft 42. A knob 44 is attached to the opposite end of the shaft 42. A spacer 46 is positioned on the shaft 42 between the key ring 40 and the knob 44. The spacer 46 is movable along the sidewall 38 and keeps the shaft 42 moving in a straight line as the key ring 40 is raised and lowered in the sidewall 38. The upper end portion 34 has an opening 48 through which the shaft 42 extends.

The sidewall 38 defines a cavity 50 on the interior of the key case 32. The cavity 50 is adjacent the opening 48 and is open thereto and is also open at the lower end portion 36 forming one cavity. The key ring 40 is movable in the cavity 50 between a raised position at which the key ring 40 is adjacent the upper end portion 34 and a lowered position at which the key ring 40 protrudes from the sidewall 38 making the keys attached to the key ring 40 available for use. The lower end portion 36 has a plurality of stop members 52 attached thereto to limit the motion of the spacer 46. The spacer travels between an uppermost position at which the spacer 46 abuts the upper end portion 34 and a lower position at which the spacer 46 rests on the stop members 52.

Referring to FIGS. 11–13, a flexible member 54 is positioned on the shaft 42. The flexible member 54 may be flat or it may have a conical, truncated conical, inverted cup, or curvilinear configuration to facilitate suspending the key ring 40 with keys attached in the key case 32 when the keys are stored and not in use. The flexible member 54 rests atop the opening 48 to suspend the key ring 40 in the stored position as shown in FIG. 11. The flexible member 54 is springy to avoid inadvertent falling of the keys and to give a live feel. When the keys are to be used, the key ring 40 is lowered so that it protrudes from the lower end portion 36.

Operation of the key case illustrated in FIGS. 8–13 is believed to be apparent from the foregoing description and drawings, but a few words will be added for emphasis. The key ring 40 is lowered by pushing the handle 44 down causing the flexible member 54 to flex and squeeze through the opening 48 so that the key ring 40 can then be lowered to its lowermost position. The downward motion of the key ring 40 is halted by the stop member 46 when it abuts the stops 52. As illustrated in FIG. 13, the flexible member 54 is inside the sidewall 38 when the key ring 40 is lowered for use.

To return the key ring 40 to its stored position, the knob 44 is pulled upward, or the keys are pushed into the sidewall 38, causing the knob 44 to protrude through the opening 48. The flexible member 54 flexes to negotiate the opening 48 and the knob 44 is pushed down so that the flexible member 54 comes to rest over the opening 48 as illustrated in FIG. 11.

Referring to FIGS. 14–15, a key case 56 is illustrated that has a key ring 58 attached to one end of a shaft 60 on the interior of the key case 56. A knob 62 is attached to the other end of the shaft 60. The shaft 60 moves through an opening in upper end portion 66. A spacer 64 is positioned on the shaft 60 between the key ring 58 and knob 62. The spacer 64 has an oval or oblong configuration as do the upper end portion 66 of the key case 56 and the sidewall 68 of the key case 56. This gives the key case 56 a generally flat configuration making it comfortable to carry in a pocket. The upper end portion 66 may be constructed of a magnetic material and the spacer 64 may be constructed of a magnetically attractive material so that the spacer 64 is held at the uppermost position adjacent the upper end portion 66 by magnetic attraction.

Alternatively, the spacer 64 may be constructed of magnetic material and the upper end portion 66 constructed of magnetically attractive material. The spacer 64 is moved from its upper position to a lower position by pushing down on the knob 62 against the force of magnetic attraction. The spacer 64 is returned to its uppermost position by pushing the keys and the key ring 58 toward the upper end portion 66 or by snapping it back into place with a snap of the wrist.

Referring to FIGS. 16–17, the key case 56' is similar to the key case illustrated in FIGS. 14–15 but does not use the principle of magnetic attraction to hold the key ring 58' in the uppermost position. In the embodiment illustrated in FIGS. 16–17, the upper end portion 66' has an opening 70 through which the shaft 60' is movable and engageable therewith to hold the key ring 58' in its uppermost position adjacent the upper end portion 66'. The spacer 64' functions to maintain the shape of the key case 56' as the key ring 58' travels between its upper position adjacent the upper end portion 66' and its lower position where it protrudes from the lower end portion of the key case 56'. The opening 70 is preferably reinforced so that it grips the shaft 60' when the shaft 60' is pushed into and through the opening 70. There is a snug fit between the shaft 60' and the opening 70 sufficient to suspend the weight of the key ring 58' and any keys that are attached to it. The shaft 60' is disengaged from the opening 70 by pushing the topmost portion of the shaft 60' downward into the key case or by a snap of the wrist.

Referring to FIG. 18, a key case 72 is illustrated which has a sidewall 74 with a slit 76 therein. A chain 78 protrudes through the slit 76. The end of the chain 78 on the interior of the sidewall 74 contains a key ring for holding a plurality of keys. The key ring is raised and lowered by moving the chain 78 along the slit 76. The advantage of this configuration is that the chain length is minimal because it does not have to come through an opening in the uppermost portion of the key case 72.

Referring to FIG. 19, a key case 72' is illustrated which has a sidewall 74' with a slit 76' therein. A chain 78' protrudes through the slit 76' and has a key ring attached to one end on the interior of the sidewall 74'. The other end of the chain 78' has a ring 80 attached thereto. The ring 80 is engageable with a neck or protrusion 82 on the key case 72' to hold the chain 78' in position to reduce noise. The engagement of the ring 80 with the neck 82 of the key case 72' also secures the key ring in its uppermost position.

It can now be appreciated that there has been described a key case for housing a plurality of keys. The key case accommodates a number of keys depending on the size of the key ring used. The key case prevents keys from poking or wearing holes in a pocket. The key case housing shields the purse or pocket from the keys and thereby prevents the keys from poking holes. The key case is compact to minimize wear. The keys lay almost flat on the key ring thereby minimizing bulging of the key case. The key case holds keys on a conventional key ring and the keys are easily removed or added.

It can also be appreciated that the key case holds a plurality of keys in a neat, compact package that shields the keys from contact with a pocket or purse and minimizes jingling. Keys are easily added or removed from the key case and the key case is simple to operate.

As is evident from the foregoing description, certain aspects of the invention are not limited to the particular details of the examples illustrated, and it is therefore contemplated that other modifications and applications will occur to those skilled in the art. For example, a VELCRO fastener could be used to keep the exterior end of the chain from jingling, or the sidewall may be lined with cloth, fur or other material to further reduce jingling. Also, while the invention has been described primarily of plastic construction, it can be constructed of leather, cloth or other materials. It is accordingly intended that the claims shall cover all such modifications and applications as do not depart from the true spirit and scope of the invention.

I claim:

1. An key case, comprising:

an upper end portion having an opening;

a lower end portion having an opening;

a sidewall extending between said upper and lower end portions and defining a cavity, said cavity being accessible through said opening of said upper end portion and through said opening of said lower end portion;

a key holding device;

means, connected to said key holding device, for raising said key holding device into said cavity adjacent said upper end portion and lowering said key holding device from said cavity through said opening of said lower end portion, said means including a shaft having a first end attached to said key holding device; and a holding device attached to a second end of said shaft a stop member on the interior of said sidewall to limit downward movement or said key holding device when contact is made with said means for raising said key holding device.

2. A key case, as set forth in claim 1, wherein said means for raising said key holding device includes:

a flexible member positioned on said shaft adjacent said holding device and having a size and configuration sufficient for resting on said upper end portion over said opening of said upper end portion without falling through said opening of said upper end portion, and for being pulled through said opening of said upper end portion to move said key holding device between said raised and lowered positions.

3. A key case, as set forth in claim 1, wherein said sidewall is flexible.

4. A key case, as set forth in claim 1, wherein said upper end portion contains a magnetically attractive material and wherein said means for raising said key holding device includes:

a magnetic member positioned about said shaft.

5. A key case, as set forth in claim 4, wherein said magnetic member is a spacer member positioned about said shaft and movable with said shaft between a raised position at which said spacer is held adjacent said upper end portion by magnetic attraction to said magnetically attractive material of said upper end portion and a lowered position at which said key holding device extends from said cavity and is free of said sidewall.

6. A key case, as set forth in claim 5, wherein said spacer has an oval configuration.

7. A key case, as set forth in claim 5, wherein said spacer has an oblong configuration.

* * * * *